US011946125B2

(12) United States Patent
Lee et al.

(10) Patent No.: US 11,946,125 B2
(45) Date of Patent: Apr. 2, 2024

(54) FERRITIC STAINLESS STEEL AND FERRITIC STAINLESS STEEL PIPE WITH IMPROVED MECHANICAL PROPERTIES OF WELDING PORTION

(71) Applicant: POSCO, Pohang-si (KR)

(72) Inventors: Kye-Man Lee, Seoul (KR); Jae-Seok Park, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 77 days.

(21) Appl. No.: 17/276,953

(22) PCT Filed: Aug. 23, 2019

(86) PCT No.: PCT/KR2019/010788
§ 371 (c)(1),
(2) Date: Mar. 17, 2021

(87) PCT Pub. No.: WO2020/067650
PCT Pub. Date: Apr. 2, 2020

(65) Prior Publication Data

US 2022/0033939 A1 Feb. 3, 2022

(30) Foreign Application Priority Data

Sep. 27, 2018 (KR) ..... 10-2018-0115263

(51) Int. Cl.
*C22C 38/28* (2006.01)
*C21D 8/10* (2006.01)
(Continued)

(52) U.S. Cl.
CPC ..... *C22C 38/28* (2013.01); *C21D 8/105* (2013.01); *C22C 38/001* (2013.01); *C22C 38/06* (2013.01);
(Continued)

(58) Field of Classification Search
CPC .. C21D 2211/005; C21D 8/02; C21D 8/0205; C21D 8/0226; C21D 8/10; C21D 8/105;
(Continued)

(56) References Cited

U.S. PATENT DOCUMENTS

2002/0043305 A1 4/2002 Fairchild et al.
2018/0031169 A1* 2/2018 Urashima ..... C22C 38/50

FOREIGN PATENT DOCUMENTS

CA 3009133 A1 8/2017
EP 1016732 A1 7/2000
(Continued)

OTHER PUBLICATIONS

Japanese Office Action dated Sep. 13, 2022 issued in Japanese Patent Application No. 2021-517346 (with English translation).
(Continued)

*Primary Examiner* — Jenny R Wu
(74) *Attorney, Agent, or Firm* — Morgan, Lewis & Bockius LLP

(57) ABSTRACT

A ferritic stainless steel with improved mechanical properties of weld zone is disclosed. The ferritic stainless steel includes, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, the remainder of iron (Fe) and other inevitable impurities, and the ferritic stainless steel has a texture maximum strength of 30 or less in the {001} direction after welding.

7 Claims, 2 Drawing Sheets

(51) Int. Cl.

| | |
|---|---|
| ***C22C 38/00*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/32*** | (2006.01) |
| ***C22C 38/40*** | (2006.01) |

(52) U.S. Cl.
CPC ..... *C22C 38/20* (2013.01); *C22C 38/22* (2013.01); *C22C 38/26* (2013.01); *C22C 38/32* (2013.01); *C22C 38/40* (2013.01); *C21D 2211/005* (2013.01)

(58) Field of Classification Search
CPC ..... C21D 9/46; C22C 38/00; C22C 38/001; C22C 38/004; C22C 38/06; C22C 38/20; C22C 38/22; C22C 38/26; C22C 38/28; C22C 38/32; C22C 38/40; C22C 38/42; C22C 38/48; C22C 38/50; C22C 38/54
See application file for complete search history.

(56) References Cited

FOREIGN PATENT DOCUMENTS

| | | | | | |
|---|---|---|---|---|---|
| JP | 06184705 | A | * | 7/1994 | |
| JP | H06-184705 | A | | 7/1994 | |
| JP | H08-120417 | A | | 5/1996 | |
| JP | 8-333656 | A | | 12/1996 | |
| JP | H08-333656 | A | | 12/1996 | |
| JP | H09-31602 | A | | 2/1997 | |
| JP | H09-316606 | A | | 12/1997 | |
| JP | H10-025551 | A | | 1/1998 | |
| JP | H10-25551 | A | | 1/1998 | |
| JP | H10-204591 | A | | 8/1998 | |
| JP | H10-298720 | A | | 11/1998 | |
| JP | 11-256287 | A | | 9/1999 | |
| JP | 11256287 | A | * | 9/1999 | ..... C22C 38/26 |
| JP | H11-256287 | A | | 9/1999 | |
| JP | 2001-003144 | A | | 1/2001 | |
| JP | 2004-243354 | A | | 9/2004 | |
| JP | 2005-105347 | A | | 4/2005 | |
| JP | 2005-264269 | A | | 9/2005 | |
| WO | WO-2016129576 | A1 | * | 8/2016 | ..... C09D 167/02 |
| WO | 2017/135240 | A1 | | 8/2017 | |

OTHER PUBLICATIONS

International Search Report dated Dec. 20, 2019 issued in International Patent Application No. PCT/KR2019/010788 (with English translation).
Korean Notice of Allowance dated Mar. 10, 2020 issued in Korean Patent Application No. 10-2018-0115263.
Korean Office Action dated Oct. 25, 2019 issued in Korean Patent Application No. 10-2018-0115263.
Chinese Office Action dated Sep. 7, 2021 issued in Chinese Patent Application No. 201980063946.3 (with English translation).
Extended European Search Report dated Aug. 31, 2021 issued in European Patent Application No. 19865786.8.
Indian Office Action dated Jan. 31, 2022 issued in Indian Patent Application No. 202117011387 (with English translation).
Japanese Office Action dated Apr. 19, 2022 issued in Japanese Patent Application No. 2021-517346 (with English translation).
Office Action dated Nov. 14, 2023 for counterpart Japanese Patent Application No. 2021-517346 (See Machine Translation).
Hearing Notice issued Jan. 17, 2024 for counterpart Indian Patent Application No. 202117011387 (See English Translation).

* cited by examiner

FERRITIC STAINLESS STEEL AND FERRITIC STAINLESS STEEL PIPE WITH IMPROVED MECHANICAL PROPERTIES OF WELDING PORTION

CROSS-REFERENCE OF RELATED APPLICATIONS

This application is the U.S. National Phase under 35 U.S.C. § 371 of International Patent Application No. PCT/KR2019/010788, filed on Aug. 23, 2019, which in turn claims the benefit of Korean Application No. 10-2018-0115263, filed on Sep. 27, 2018, the entire disclosures of which applications are incorporated by reference herein.

TECHNICAL FIELD

The present disclosure relates to ferritic stainless steel, in particular ferritic stainless steel with improved mechanical properties of weld zone and ferritic stainless steel pipe.

BACKGROUND ART

Stainless steel refers to steel that has strong corrosion resistance by suppressing corrosion, which is a weak point of carbon steel. In general, stainless steel is classified according to its chemical composition or metal structure. According to the metal structure, stainless steel can be classified into austenite-based, ferrite-based, martensite-based and dual phase-based.

Among them, ferritic stainless steel is applied to various industrial fields such as home appliances and kitchen appliances because it has excellent corrosion resistance while adding less expensive alloying elements.

In particular, when used as a material for exhaust pipes, fuel tanks or pipes of automobiles or two-wheeled vehicles, corrosion resistance and heat resistance are required when exposed to exhaust environments and fuel environments, as well as formability during cold working.

In recent years, as automobile exhaust system parts become lighter and more complex in shape, it is necessary to improve mechanical properties and formability of materials for exhaust system parts. For this, it became easy to improve the mechanical properties and formability of the steel itself through the development of microstructure and texture improvement technology of ferritic stainless steel.

However, in the welding process that occurs when ferritic stainless steel is used as a material for exhaust pipes, fuel tanks or pipes of automobiles or two-wheeled vehicles, the steel material is reheated at high temperature, so it loses the fine structure and the texture excellent in formability, and a very coarse columnar crystal grain is formed.

This phenomenon is more pronounced in the weld zone including the fusion zone and heat-affected zone, which causes the stability of the product to deteriorate. Therefore, finely controlling the grain size of the weld zone is essential to improve the mechanical properties of products manufactured through welding. As a means for miniaturizing the structure of the weld zone, a technology for controlling grain coarsening by TiN and a technology for generating ferrite in grains by Ti oxide have been studied and put into practice. However, the technology for controlling the texture of the weld zone along with the weld zone microstructure has not been developed.

DISCLOSURE

Technical Problem

The embodiments of the present disclosure are intended to provide ferritic stainless steel with improved mechanical properties of weld zone and ferritic stainless steel pipe by controlling the weld zone microstructure and texture.

Technical Solution

In accordance with an aspect of the present disclosure, a ferritic stainless steel with improved mechanical properties of weld zone includes, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, the remainder of iron (Fe) and other inevitable impurities, and the ferritic stainless steel has a texture maximum strength of 30 or less in the {001} direction after welding.

The ferritic stainless steel may include a secondary phase present in the weld zone of 10 to 100 pieces/mm$^2$ after welding.

The secondary phase may include nitride, oxide and Laves phase precipitates.

The ferritic stainless steel may further include at least one of Mo: 1.0% or less, Ni: 1.0% or less, Cu: 1.0% or less, and B: 0.005% or less.

In accordance with another aspect of the present disclosure, a ferritic stainless steel pipe includes: a base material including, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, the remainder of iron (Fe) and other inevitable impurities, and a weld zone having a texture maximum strength of 30 or less in the {001} direction.

The weld zone may include a secondary phase of 10 to 100/mm$^2$.

The secondary phase may include nitride, oxide and Laves phase precipitates.

The base material may further include at least one of Mo: 1.0% or less, Ni: 1.0% or less, Cu: 1.0% or less, and B: 0.005% or less.

A ductile to brittle transition temperature (DBTT) of the weld zone may be −50° C. or less.

Advantageous Effects

According to an embodiment of the present disclosure, a ferritic stainless steel with improved mechanical properties of weld zone and a ferritic stainless steel pipe may be provided.

MODES OF THE INVENTION

Figure 1:
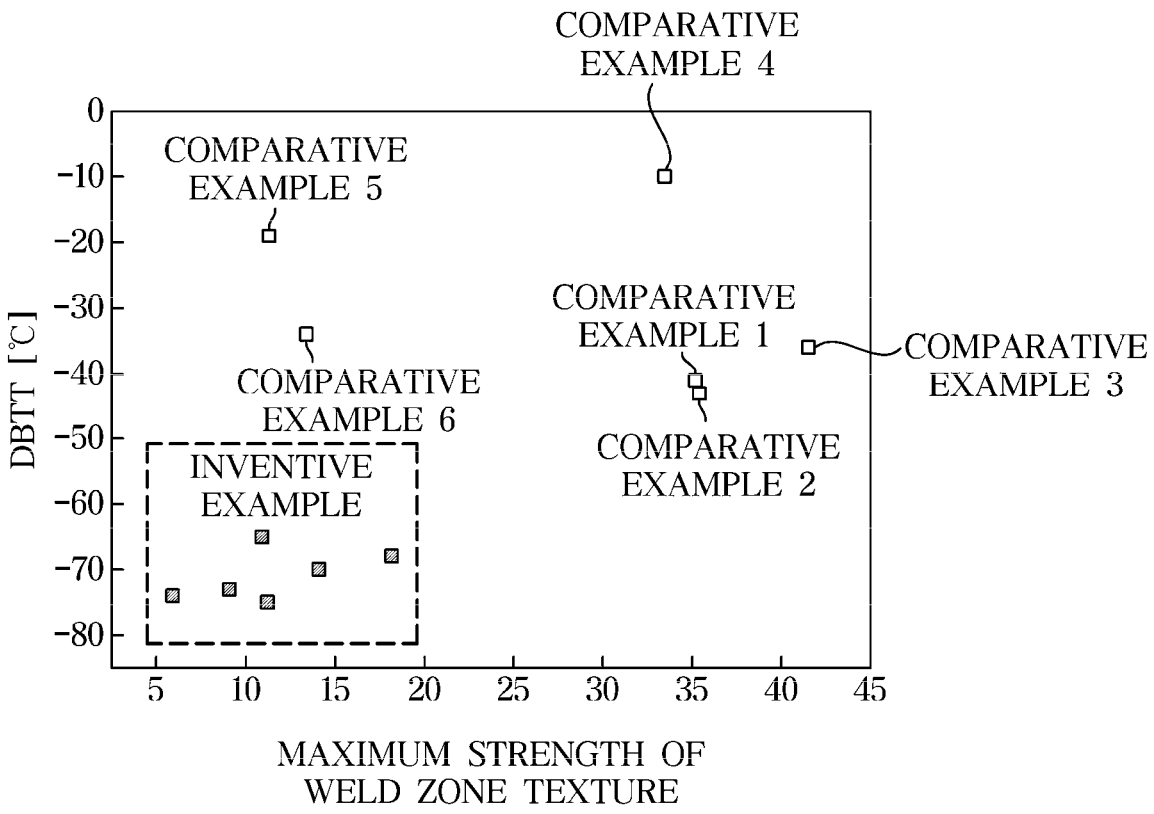
FIG. 1 is a graph for illustrating a relationship between a weld zone texture maximum strength of ferritic stainless steel and a ductile-brittle transition temperature (DBTT) according to an embodiment of the present disclosure.

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

Hereinafter, embodiments according to the present disclosure will be described in detail with reference to the accompanying drawings.

During stainless steel welding, a weak secondary phase is formed by rapid heating/quenching in the weld zone, which can act as a major factor in lowering toughness. The weld zone is a concept including a fusion zone and a heat-affected zone (HAZ). In addition, the secondary phase in the present disclosure refers to a phase different from the stainless steel base material, specifically including precipitates such as oxide, nitride, and Laves phase.

Precipitates that may be formed during welding in ferritic stainless steel include chromium carbide ($Cr_3O_2$), chromium nitride (CrN), and chromium carbonitride (CrCN). These precipitates consume the chromium of the ferritic stainless steel base material, which causes a decrease in weld zone corrosion resistance. Therefore, it is necessary to suppress the formation of such precipitates by controlling the content of carbon and nitrogen bonded to chromium as low as possible.

In addition, precipitates such as a sigma phase and a Laves phase may reduce the brittleness and corrosion resistance of the material, and thus formation thereof needs to be suppressed.

On the other hand, in the ferritic stainless steel welding process, the molten metal has anisotropy of crystal orientation due to the difference in cooling rate. That is, when the molten metal is solidified, columnar crystal grains are formed in a direction in which cooling occurs preferentially, and at this time, the columnar crystal grows in the {001} direction, which has the lowest interfacial energy.

When grains having a similar orientation are clustered, stress is concentrated in the cluster with inferior mechanical properties, which degrades the mechanical properties of ferritic stainless steel. Therefore, when considering the weld zone mechanical properties, it is necessary to derive the texture of the weld zone as disorderly as possible.

In addition, since grain growth occurs in the heat-affected zone, the mechanical properties of weld zone may be lowered. Therefore, it is important to form a fine equiaxed crystal structure in order to improve the mechanical properties of weld zone.

To consider both the strength and toughness of the weld zone of ferrite stainless steel, the present inventors have found that the distribution density of the secondary phase should be controlled, and at the same time, a disordered texture should be derived. As a result of the experiment, the present inventors were able to derive a weld zone microstructure and texture condition capable of improving weld zone mechanical properties.

In accordance with an aspect of the present disclosure, a ferritic stainless steel with improved mechanical properties of weld zone includes, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, the remainder of iron (Fe) and other inevitable impurities.

Hereinafter, the reason for limiting the numerical value of the content of the alloying component in the embodiment of the present disclosure will be described. Hereinafter, unless otherwise specified, the unit is % by weight.

The content of C is 0.005 to 0.02%.

Carbon (C) is an interstitial solid solution strengthening element and improves the strength of ferritic stainless steel. In addition, since it combines with titanium (Ti) or niobium (Nb) to form carbides to suppress grain growth, it is an essential element in order to refine the grains of the heat-affected zone. Therefore, 0.005% or more can be added in the present disclosure. However, if the content is excessive, it may cause brittleness by forming a martensite phase during welding, so the upper limit may be limited to 0.02%.

The content of N is 0.005 to 0.02%.

Nitrogen (N), like carbon, is an interstitial solid solution strengthening element and improves the strength of ferritic stainless steel, and it can inhibit grain growth by forming nitride by combining with titanium (Ti) or niobium (Nb). In addition, since such nitride acts as a grain nucleation site during solidification of molten metal during welding, it promotes the formation of equiaxed crystal grains having disordered orientations, and thus can be added by 0.005% or more. However, if the content is excessive, it may cause brittleness by forming a martensite phase during welding, so the upper limit may be limited to 0.02%.

The content of Cr is 11.0 to 13.0%.

Chromium (Cr) is a ferrite stabilizing element and can be added at least 11.0% to secure corrosion resistance required for stainless steel. However, if the content is excessive, there is a problem that the manufacturing cost increases and formability is inferior, so the upper limit can be limited to 13.0%.

The content of Ti is 0.16 to 0.3%.

Titanium (Ti) is an essential element for grain refinement because it suppresses grain growth by forming carbonitrides by combining with interstitial elements such as carbon (C) and nitrogen (N). In addition, titanium (Ti) is combined with nitrogen (N) or oxygen (O) to form nitride and oxide. These secondary phases act as grain nucleation sites during the solidification of molten metal during welding and promote the formation of equiaxed crystal grains having disordered orientations, and therefore, titanium can be added by 0.16% or more. However, if the content is excessive, it causes an increase in cost, and there is difficulty in manufacturing by forming an excessively large number of inclusions, so the upper limit may be limited to 0.3%.

The content of Nb is 0.1 to 0.3%.

Niobium (Nb) inhibits grain growth by combining with interstitial elements such as carbon (C) and nitrogen (N) to form carbonitrides, and thus, 0.1% or more can be added for grain refinement. However, if the content is excessive, the upper limit may be limited to 0.3%, since it causes an increase in cost and increases the brittleness of the weld zone by forming Laves precipitates during the welding process, thereby lowering the mechanical properties.

The content of Al is 0.005 to 0.05%.

Aluminum (Al) is an element that is essentially added for deoxidation, and since it forms oxide that acts as a weld zone nucleation site in the present disclosure, more than 0.005% can be added. However, if the content is excessive, the penetration rate during welding decreases and weldability decreases, so the upper limit may be limited to 0.05%.

In addition, ferritic stainless steel with improved mechanical properties of weld zone according to an embodiment of the present disclosure may further include, in percent (%) by weight, at least one of Mo: 1.0% or less, Ni: 1.0% or less, Cu: 1.0% or less, and B: 0.005% or less.

The content of Mo is 1.0% or less.

Molybdenum (Mo) may be additionally added to improve corrosion resistance, and if it is added in an excessive amount, the impact characteristics are deteriorated, thereby increasing the risk of fracture during processing and increasing the cost of the material. Therefore, in the present disclosure, it is desirable to consider this and limit the upper limit to 1.0%.

The content of Ni is 1.0% or less.

Nickel (Ni) is an element that improves corrosion resistance, and when a large amount is added, it is hardened and there is a concern that stress corrosion cracking may occur. Therefore, it is preferable to limit the upper limit to 1.0%.

The content of Cu is 1.0% or less.

Copper (Cu) may be additionally added to improve corrosion resistance, and if excessively added, there is a problem that the workability is deteriorated, so it is preferable to limit the upper limit to 1.0%.

The content of B is 0.005% or less.

Boron (B) is an effective element in securing good surface quality by suppressing the occurrence of cracks during casting. However, if the content is excessive, nitride (BN) may be formed on the product surface during the annealing/pickling process, thereby reducing the surface quality. Therefore, the upper limit may be limited to 0.005%.

The remaining component of the present disclosure is iron (Fe). However, since unintended impurities from the raw material or the surrounding environment may inevitably be mixed in the normal manufacturing process, this cannot be excluded. Since these impurities are known to anyone of ordinary skill in the manufacturing process, all the contents are not specifically mentioned in the present specification.

Hereinafter, a texture of a weld zone of a ferritic stainless steel with improved mechanical properties of weld zone according to an embodiment of the present disclosure will be described in detail.

During welding, the solidification process begins in the partially molten region of the ferritic stainless steel base material metal. During the solidification process, a columnar crystal microstructure with a specific preferred orientation is formed. Specifically, the columnar crystal structure tends to grow in the {001} direction, which is disadvantageous in formability due to the anisotropy of the interfacial energy. This columnar crystal structure is known to degrade weld zone mechanical properties. Therefore, the formation of a columnar crystal structure during the welding process of most metal materials is a factor that must be controlled.

Therefore, in order to improve the mechanical properties of weld zone, it is necessary to suppress the formation of grains having a {001} plane and increase the volume fraction of grains having a disordered orientation.

An arrangement with a certain plane and orientation generated inside the crystal is called texture, and the texture can be quantified through the orientation distribution function (ODF).

In the present disclosure, the maximum strength of the ODF was introduced as a texture index. The grains of the fusion zone and heat affected zone were measured using Electron Backscattered Diffraction (EBSD), and the ODF was calculated from the crystal orientations of the fusion zone and heat affected zone. The strength of the ODF refers to how many times the orientation as compared to a specimen with a completely disordered texture. That is, a high maximum strength of the ODF means that there are many grains having a specific orientation, and a texture maximum strength of 30 or less means that preferential development of a specific orientation is suppressed.

FIG. 1 is a graph for illustrating a relationship between a weld zone texture maximum strength of ferritic stainless steel and a ductile-brittle transition temperature (DBTT) according to an embodiment of the present disclosure.

DBTT is a ductile to brittle transition temperature, and the fracture behavior changes from ductile fracture to brittle fracture based on the DBTT temperature, which is the main cause of cracking when processing the weld zone under low temperature conditions. Therefore, it is desirable that the DBTT is low.

According to an embodiment of the present disclosure, a maximum strength of a weld zone texture of a ferritic stainless steel with improved mechanical properties of weld zone that satisfies the above-described alloy composition may be 30 or less.

Referring to FIG. 1, it can be seen that DBTT tends to increase as the weld zone texture maximum strength increases. Specifically, in the case where the maximum strength of the weld zone texture is 30 or less, the weld zone DBTT value satisfies −50° C. or less. That is, it can be seen that the mechanical properties of weld zone are improved compared to the comparative examples.

In order to develop the texture of ferritic stainless steel disorderly, the alloy components and the distribution density of secondary phase is important. In general, ferritic stainless steel is a complete single-phase steel that does not undergo phase transformation during melting and solidification. If no special measures are taken, a very strong {001} texture develops during melting and solidification. This is because the nucleated grains grow along the <001> direction, which is the preferred orientation. Increasing the number of nucleation sites per unit area during solidification minimizes grain growth during solidification and lowers the maximum strength of the texture.

During welding, the secondary phase formed in the molten metal can act as a nucleation site during cooling and solidification.

When the secondary phase is formed in the molten metal, the structure of the weld zone can be refined by increasing the nucleation site, so studies have been conducted to form the secondary phase in the molten metal through oxide metallurgy and nitride metallurgy.

TiN nitride and Ti—Al—O oxide may be formed in the liquid phase of ferritic stainless steel to which Ti and Nb are added in combination according to the disclosed embodiment. As the number of nitride and oxide formed in liquid ferritic stainless steel increases, the weld zone grain size decreases, and at the same time, it promotes disordered texture development and improves weld zone mechanical properties.

On the other hand, in order to derive the texture of the weld zone disorderly, it is necessary to increase the grain nucleation event during solidification. Since uniform nucleation easily occurs as the degree of supercooling increases during solidification, cooling should be performed as quickly as possible during welding, but this has a limitation in the welding process. In order to overcome this limitation, as described above, by forming a secondary phase in the molten metal, disorder of the texture is derived through non-uniform nucleation.

Figure 2:
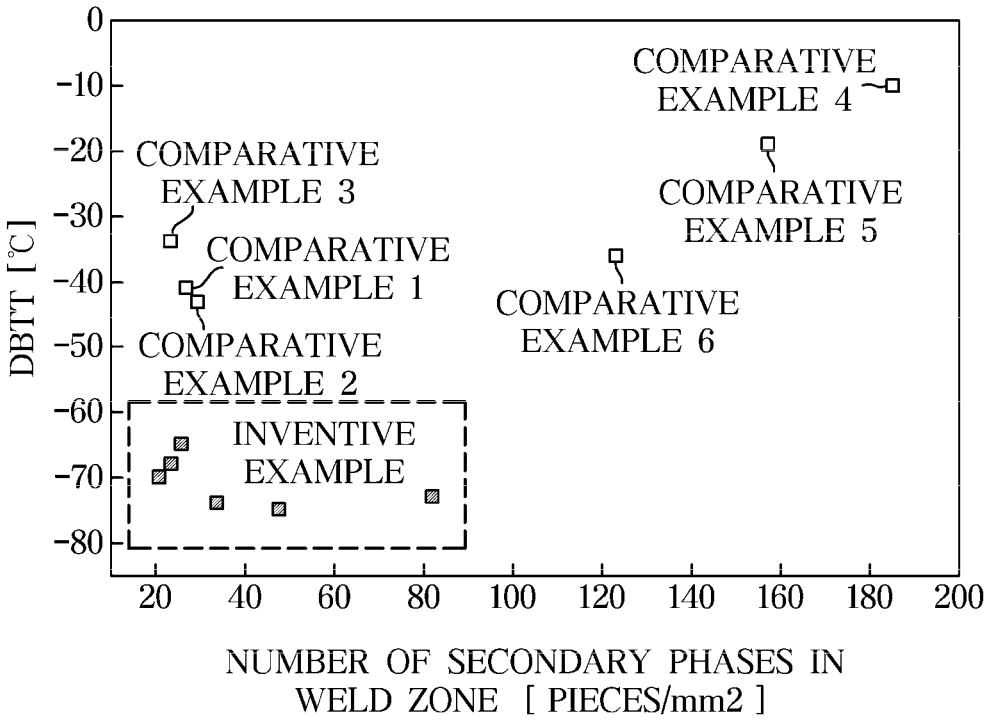
FIG. 2 is a graph for illustrating the relationship between the distribution density of the secondary phase of the weld zone of ferritic stainless steel and the ductile-brittle transition temperature (DBTT) according to an embodiment of the present disclosure.

FIG. 2 is a graph for illustrating the relationship between the distribution density of the secondary phase of the weld zone of ferritic stainless steel and the ductile-brittle transition temperature (DBTT) according to an embodiment of the present disclosure.

Referring to FIG. 2, it can be seen that DBTT tends to increase as the distribution density of the weld zone secondary phase increases. Specifically, to obtain a DBTT value of −50° C. or less, a distribution density of the secondary phases of 100 or less per $mm^2$ is required.

In this way, in order to refine the grains of the ferritic stainless steel weld zone satisfying the above-described alloy composition and suppress the development of a specific orientation texture, the distribution density of nitride or oxide present in the weld zone should be 10 pieces/$mm^2$ or more.

However, if there are too many secondary phases in the weld zone, it causes brittleness, so its distribution density must be limited. In particular, the secondary phase formed at low temperature, such as the Laves phase, does not affect grain nucleation and only increases brittleness, so formation should be suppressed. Therefore, the distribution density of all secondary phases including nitride, oxide, and laves precipitates existing in the weld zone can be limited to 100/$mm^2$ or less.

Hereinafter, the present disclosure will be described in more detail through examples.

For various alloy component ranges shown in Table 1 below, a slab having a thickness of 200 mm was prepared by melting an ingot, heated at 1,240° C. for 2 hours, and then hot-rolled to prepare a hot-rolled steel sheet having a thickness of 3 mm.

Thereafter, after welding by the GTA process in order to evaluate the welding characteristics of the steel sheet manufactured according to the above Inventive Examples and Comparative Examples, the grain size of the weld zone, weld zone texture, and weld zone impact energy were investigated. As the main influencing factors, the molten steel component and the number of internal secondary phases, texture, and DBTT were investigated and shown in Tables 1 and 2 below.

TABLE 1

| | C | N | Cr | Ti | Nb | Al | Mo | Ni | Cu | B |
|---|---|---|---|---|---|---|---|---|---|---|
| Inventive Example 1 | 0.005 | 0.009 | 12.8 | 0.168 | 0.146 | 0.035 | 0.004 | 0.06 | 0.01 | 0.001 |
| Inventive Example 2 | 0.006 | 0.007 | 12.0 | 0.23 | 0.145 | 0.028 | 0.004 | 0.07 | 0.016 | 0.002 |
| Inventive Example 3 | 0.005 | 0.009 | 12.3 | 0.296 | 0.165 | 0.029 | 0.002 | 0.13 | 0.014 | 0.001 |
| Inventive Example 4 | 0.007 | 0.009 | 11.3 | 0.22 | 0.123 | 0.022 | 0.005 | 0.07 | 0.016 | 0.001 |
| Inventive Example 5 | 0.008 | 0.009 | 11.7 | 0.21 | 0.22 | 0.016 | 0.004 | 0.06 | 0.01 | 0.003 |
| Inventive Example 6 | 0.006 | 0.009 | 12.4 | 0.221 | 0.29 | 0.028 | 0.002 | 0.05 | 0.011 | 0.002 |
| Comparative Example 1 | 0.006 | 0.007 | 11.5 | 0.105 | 0.164 | 0.031 | 0.004 | 0.06 | 0.014 | 0.001 |
| Comparative Example 2 | 0.005 | 0.008 | 12.2 | 0.147 | 0.174 | 0.022 | 0.003 | 0.06 | 0.01 | 0.001 |
| Comparative Example 3 | 0.007 | 0.009 | 12.2 | 0.054 | 0.031 | 0.029 | 0.005 | 0.1 | 0.02 | 0.002 |
| Comparative Example 4 | 0.006 | 0.007 | 11.8 | 0.112 | 0.48 | 0.031 | 0.002 | 0.08 | 0.009 | 0.001 |
| Comparative Example 5 | 0.007 | 0.009 | 12.1 | 0.321 | 0.456 | 0.026 | 0.005 | 0.06 | 0.011 | 0.002 |
| Comparative Example 6 | 0.006 | 0.009 | 12.3 | 0.181 | 0.35 | 0.026 | 0.004 | 0.07 | 0.016 | 0.003 |

The texture was measured using the Electron Backscatter Diffraction (EBSD) method to measure the area including the total thickness direction of the cross section of the weld zone including the fusion zone and the heat-affected zone. Texture was quantified by calculating ODF from EBSD data, and the maximum strength of ODF was used as a texture index.

In addition, for mechanical properties of weld zone, DBTT obtained by measuring impact energy from −60 to 100° C. at intervals of 20° C. through Charpy impact test according to ASTM E 23 standard is shown in Table 2.

TABLE 2

| | number of nitride + oxide (pieces/mm$^2$) | number of nitride + oxide + Laves (pieces/mm$^2$) | texture maximum strength | DBTT (° C.) |
|---|---|---|---|---|
| Inventive Example 1 | 13 | 18 | 18.2 | −68 |
| Inventive Example 2 | 24 | 21 | 10.9 | −65 |
| Inventive Example 3 | 27 | 30 | 5.9 | −74 |
| Inventive Example 4 | 15 | 15 | 14.1 | −70 |
| Inventive Example 5 | 14 | 46 | 11.2 | −75 |
| Inventive Example 6 | 15 | 86 | 9.1 | −73 |
| Comparative Example 1 | 6 | 22 | 35.2 | −41 |
| Comparative Example 2 | 8 | 25 | 35.4 | −43 |
| Comparative Example 3 | 3 | 18 | 41.5 | −34 |
| Comparative Example 4 | 7 | 188 | 33.5 | −10 |
| Comparative Example 5 | 32 | 164 | 11.3 | −19 |
| Comparative Example 6 | 11 | 134 | 13.4 | −36 |

FIG. 1 is a graph for illustrating a relationship between a weld zone texture maximum strength of ferritic stainless steel and a ductile-brittle transition temperature (DBTT) according to an embodiment of the present disclosure.

FIG. 2 is a graph for illustrating the relationship between the distribution density of the secondary phase of the weld zone of ferritic stainless steel and the ductile-brittle transition temperature (DBTT) according to an embodiment of the present disclosure.

As described above, in order to secure the weld zone mechanical properties, the weld zone texture maximum strength should be controlled to 30 or less by increasing the volume fraction of grains having disordered orientations, and at the same time, the distribution density of the weld zone secondary phase should be controlled to 10 to 100 pieces/mm$^2$.

Referring to FIGS. 1, 2 and Table 2, in the case of the above examples, compared with the comparative examples, it can be confirmed that the DBTT value is −50° C. or less by satisfying the weld zone secondary phase distribution density and the range of texture maximum strength.

In contrast, in Comparative Examples 1 to 3, the Ti content was less than 0.16%, so that the number of nitride and oxide per unit area (mm$^2$) of the weld zone was less than 10, and the texture maximum strength of the weld zone was 30 or more. That is, it can be confirmed that the texture with a specific preferred orientation has been strongly developed.

In Comparative Example 4, as in Comparative Examples 1 to 3, not only the Ti content was less than 0.16%, but also Laves precipitates were excessively formed due to excessive addition of Nb to 0.48%, so that the distribution density of the weld zone secondary phase exceeded the upper limit of the present disclosure.

In Comparative Examples 5 and 6, the number of nitride and oxide per unit area of the weld zone was 10 or more, and the maximum texture strength was 20.0 or less, so that a texture suitable for the weld zone mechanical properties was obtained. However, the content of Nb exceeded 0.3%, which is the upper limit of the present disclosure, and the distribution density of the weld zone secondary phase exceeded 100 pieces/mm$^2$, which means that laves precipitates were excessively formed, resulting in a high DBTT value.

Ferritic stainless steel manufactured according to an embodiment of the present disclosure can improve mechanical properties by deriving a disordered weld zone texture by controlling the weld zone texture maximum strength to 30 or less.

In addition, ferritic stainless steel manufactured according to an embodiment of the present disclosure may secure toughness as well as strength by controlling the secondary phase distribution density to 10 to 100 pieces/mm$^2$.

In the above description, exemplary embodiments of the present disclosure have been described, but the present disclosure is not limited thereto. Those of ordinary skill in the art will appreciate that various changes and modifications can be made without departing from the concept and scope of the following claims.

The invention claimed is:

1. A ferritic stainless steel comprising, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, Mo: 0.005% or less, B: 0.005% or less, the remainder of iron (Fe) and other inevitable impurities, and the ferritic stainless steel has a texture maximum strength of 30 or less in the {001} direction after welding, wherein the ferritic stainless steel comprises a secondary phase present in the weld zone of 10 to 100 pieces/mm$^2$ after welding, and wherein the secondary phase comprises nitride, oxide and Laves phase precipitates.

2. The ferritic stainless steel according to claim 1, further comprising: at least one of Ni: 1.0% or less, and Cu: 1.0% or less.

3. The ferritic stainless steel according to claim 1, comprising B: 0.001 to 0.005%.

4. A ferritic stainless steel pipe comprising:

a base material comprising, in percent (%) by weight of the entire composition, C: 0.005 to 0.02%, N: 0.005 to 0.02%, Cr: 11.0 to 13.0%, Ti: 0.16 to 0.3%, Nb: 0.1 to 0.3%, Al: 0.005 to 0.05%, Mo: 0.005% or less, B: 0.005% or less, the remainder of iron (Fe) and other inevitable impurities, and a weld zone having a texture maximum strength of 30 or less in the {001} direction, wherein the weld zone comprises a secondary phase of 10 to 100 pieces/mm$^2$, wherein the secondary phase comprises nitride, oxide and Laves phase precipitates, and wherein a ductile to brittle transition temperature (DBTT) of the weld zone is −50° C. or less.

5. The ferritic stainless steel pipe according to claim 4, wherein the base material further comprises at least one of Ni: 1.0% or less, and Cu: 1.0% or less.

6. The ferritic stainless steel pipe according to claim 4, wherein the weld zone has a texture maximum strength of 14.1 or less in the {001} direction.

7. The ferritic stainless steel pipe according to claim 4, wherein the weld zone comprises 10 to 46 pieces/$mm^2$ of the secondary phase.

* * * * *